US005396221A

United States Patent [19]

Bridges

[11] Patent Number: 5,396,221

[45] Date of Patent: Mar. 7, 1995

[54] SMOKE DETECTOR DISGUISED AS A CHRISTMAS TREE ORNAMENT

[76] Inventor: James E. Bridges, 110 River Ct. North, Atlanta, Ga. 30328

[21] Appl. No.: 82,367

[22] Filed: Jun. 28, 1993

[51] Int. Cl.[6] ..... G08B 17/10

[52] U.S. Cl. ..... 340/628; 340/691; 340/693

[58] Field of Search ..... 340/628, 629, 630, 691, 340/693, 594

[56] References Cited

U.S. PATENT DOCUMENTS

| | | | |
|---|---|---|---|
| 3,892,930 | 7/1975 | Wieder | 340/628 |
| 4,004,288 | 1/1977 | Webb, Jr. | 340/628 |
| 4,075,614 | 2/1978 | White | 340/594 |
| 4,525,703 | 6/1985 | Bellino | 340/628 |
| 4,529,976 | 7/1985 | Jameson et al. | 340/628 |
| 4,623,878 | 11/1986 | Schoenwetter | 340/628 |
| 4,796,015 | 1/1989 | Admire, Jr. | 340/628 |
| 4,904,988 | 2/1990 | Nesbit et al. | 340/628 |
| 4,954,816 | 9/1990 | Mattison | 340/693 |

*Primary Examiner*—Jeffery A. Hofsass

*Attorney, Agent, or Firm*—Oblon, Spivak, McClelland, Maier & Neustadt

[57] ABSTRACT

A smoke alarm is disguised as a Christmas tree ornament. A lamp is connected between a power source and the control circuit of the alarm and is located on the ornament in a position where it is a part of the ornamentation. Should the lamp be extinguished this would signal that the control circuit has become disconnected from the power source calling for instant investigation and, if necessary, repair.

1 Claim, 3 Drawing Sheets

SMOKE DETECTOR DISGUISED AS A CHRISTMAS TREE ORNAMENT

FIELD OF THE INVENTION

This invention relates to smoke detectors and more particularly to a smoke detector particularly, though not exclusively adapted for use on Christmas trees.

BACKGROUND OF THE INVENTION

A fire, as opposed to a smoke, detector disguised as a Christmas tree ornament is disclosed in the U.S. Pat. No. 4,075,614 to White. Fire detectors usually involve the use of heat meltable fuse or bi-metallic elements for controlling normally open alarm switches and both of which require the presence of actual flame in order to effect closing of the switches. An alarm system responsive only to the heat of actual flame is extremely dangerous since by the time the flame has effected actuation of the alarm it may be too late to prevent serious damage.

The U.S. Pat. No. 4,623,878 to Schoenwetter provides a Christmas tree mounted smoke alarm in the form of an annulus having a central opening whereby the detector may be engaged in a horizontal disposition over the very top of the tree. The detector may be disguised by the twigs at the top of the tree and also a separate ornament, such as a star may be located at the top of the tree in front of the detector to further disguise it. In neither of the above arrangements of respective fire or smoke detectors is there any means for indicating that the detectors have a positive connection with a source of power. Schoenwetter has a low-battery indicator light 44 but that is illuminated only when the battery power is low.

BRIEF DESCRIPTION OF THE INVENTION

The principal object of the invention is to provide a Christmas tree smoke detector disguised as a Christmas tree ornament and including an indicator lamp which is illuminated so long as the circuitry of the smoke detector is operatively connected to a power source, the indicator lamp being located on the ornament as if it were an integral part of the ornament. The ornament might be a star, Rudolph the Red Nosed Reindeer, or any other ornament of which an illuminated lamp would be an appropriate accessory.

Other objects and their attendant advantages will become apparent as the following detailed description is read in conjunction with the accompanying drawings wherein:

DETAILED DESCRIPTION OF THE INVENTION

Figure 1:
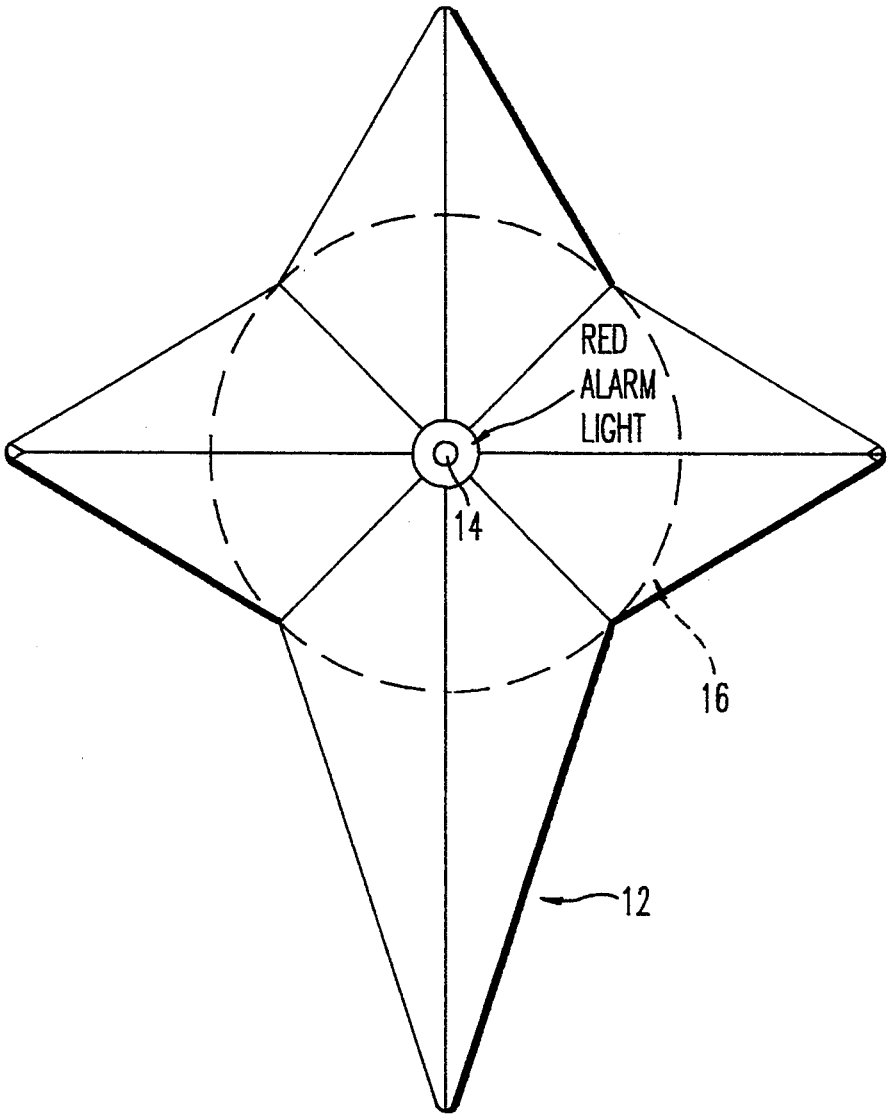
FIG. 1 is a front elevational view of a typical Christmas tree ornament incorporating a smoke alarm and including a lamp in the power circuit which is normally lit to indicate that the connection between an electrical power source and the alarm is intact.
Figure 2:
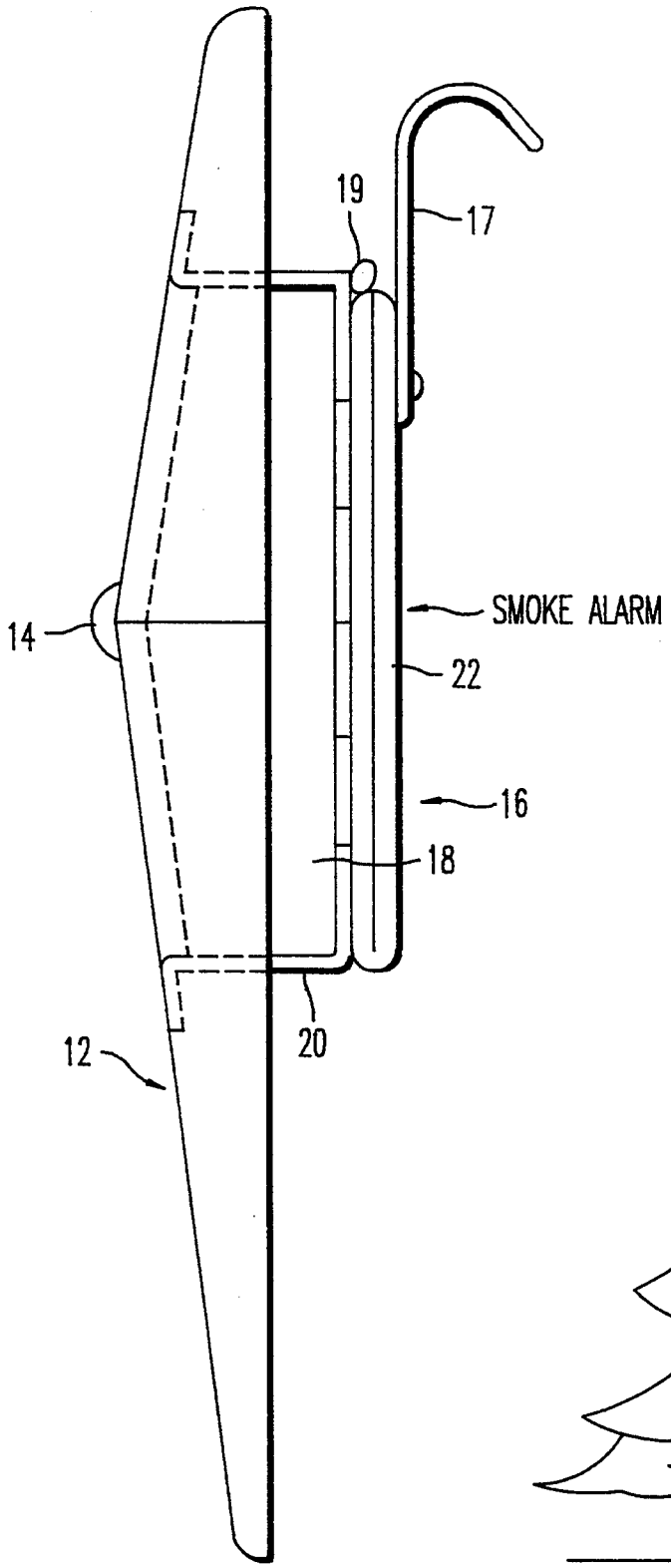
FIG. 2 is a side elevational view of the combined ornament and smoke alarm of FIG. 1.
Figure 3:
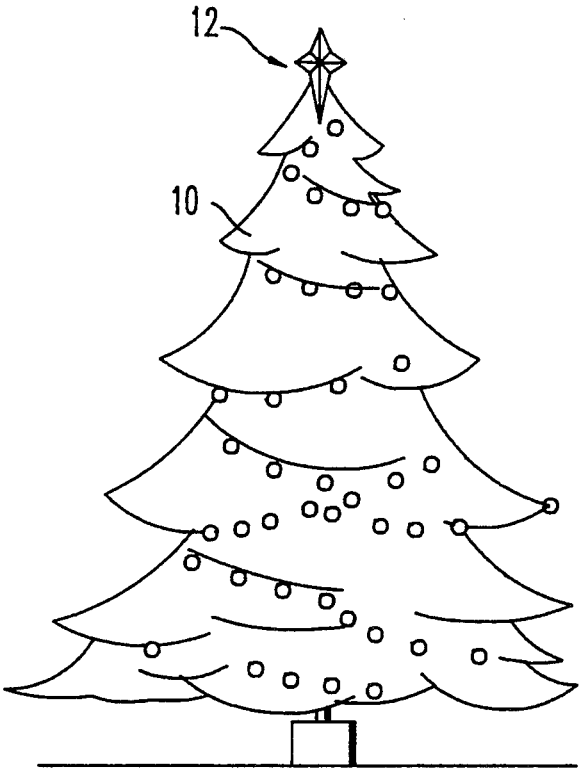
FIG. 3 is a front elevational view on a reduced scale of a Christmas tree and a preferred location thereon of a combined ornament and smoke alarm.

Referring now to the drawings the numeral 10 designates a typical Christmas tree decorated with the usual lights and ornaments including an ornament 12 on which is positioned a lamp 14, that, when lit, forms a visible part of the overall design of the ornament. Preferably the lamp, when lit, is red and when carried by a star-shaped ornament is located in the center of the star. Should the ornament be a reindeer, the lamp might be located at is nose; if an angel the lamp might appear as a torch held in an upraised hand of the angel and so on.

In accordance with the invention a smoke detector assembly 16 is connected to the ornament in a position, usually at its back, where the assembly is hidden from view by the ornament when the latter is mounted on the Christmas tree, as by a hook 17 carried by the casing 18 for the smoke detector assembly 16, in an optimum position for being viewed and for detecting smoke, that position usually being at the front of the tree near its top. The detector assembly 16 may be releasably connected to the ornament 12 in any of a variety of ways, one being as illustrated wherein bends 19 at the outer ends of spring clips 20, fixed to the inner face of the ornament, engage an annular groove 22 around the distal end of casing 18 of the smoke detector assembly, which is conventional in every respect and may include a smoke sensor, such as the ionization chamber 26 shown in FIG. 4. In addition, the assembly includes an alarm signalling device 28, and an alarm control circuit 30 for energizing the alarm 28 in response to smoke detected by the sensor 26. Electric circuitry 32 connects the alarm control circuit 30 to an electrical power source 34 which may be entirely external of the detector assembly, that is to say, it may be the house mains connected to the circuitry 32 by a conventional plug (not shown), batteries carried by the assembly or a combination of both house main power and battery power.

Figure 4:
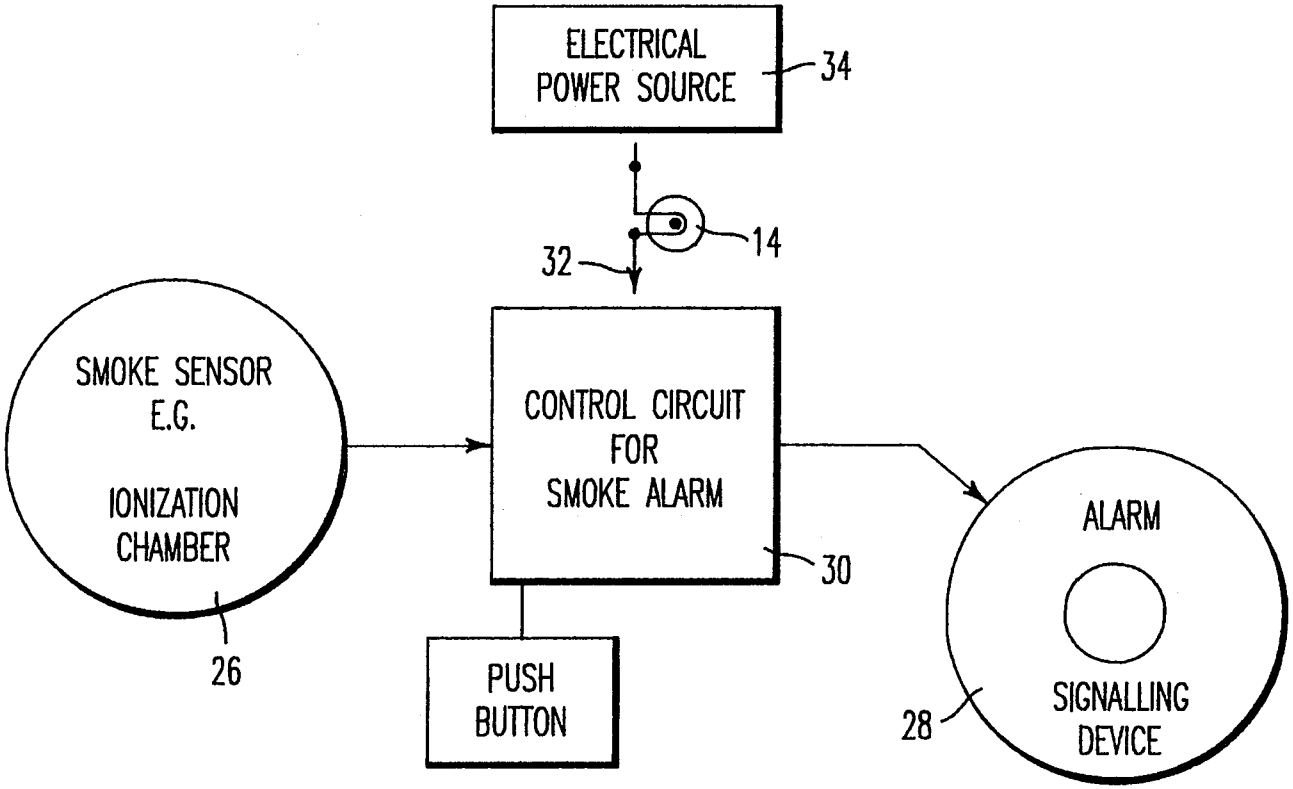
FIG. 4 is a diagram showing, typically, major functional blocks of the smoke alarm including the lamp of the invention interposed between a control circuit for the smoke alarm and its source of power.

In any event and in accordance with the invention the otherwise decorative, and preferably red, lamp 14 is connected in the circuitry 32, as schematically shown in FIG. 4, and is extinguished when the power source 34 no longer supplies electrical energy to the control circuit for the smoke alarm. It is contemplated that lamp 14 will be lit continuously throughout the relatively short period of time, on the average about two weeks, when the Christmas tree is mounted in the home. The illuminated red light will always be in a position for ready observation and should it, for any reason, become extinguished, a prompt investigation can be made as to the cause of its extinguishment and corrective action taken to restore the lamp to its illuminated state. It is, of course, within the purview of the invention to provide an auxiliary switch in the circuitry 32 to enable the lamp to be extinguished voluntarily, thereby saving battery power, when all of the Christmas tree lights are extinguished and the prospects of fire in the Christmas tree are at a minimum.

Having now described the invention I claim:

1. A smoke detector for a Christmas tree comprising, in combination, a Christmas tree ornament including a lamp positioned on said ornament that when lit said lamp forms a visible integral and complementary part of the overall design of said ornament, a smoke detector assembly connected to said ornament in a position wherein said assembly is hidden from view by said ornament when the latter is mounted on a Christmas tree in an optimum position for being viewed and for detecting smoke, said smoke detector assembly including a casing, a smoke sensor, an alarm signalling device, an alarm control circuit connected to said smoke sensor and said alarm signalling device, and electrical circuitry connecting said alarm control circuit to an electrical power source to maintain said control circuit continuously energized in readiness for actuating said alarm signalling device in response to the presence of smoke, means for mounting said ornament and its connected smoke detector assembly on a Christmas tree in an optimum position for viewing said ornament and lamp as a part of said ornament and also for detecting smoke, said lamp being connected in said circuitry so as to be lit as long as the connection between said control circuit and said power source is intact, extinguishment of said lamp signalling failure of the connection between said control circuit and said power source.

* * * * *